United States Patent [19]

Straw et al.

[11] 4,302,347

[45] Nov. 24, 1981

[54] ALL-PURPOSE LIQUID ABRASIVE CLEANER

[75] Inventors: Alan Straw, Macclesfield; Edwin Cropper, Oldham; Alan Dillarstone, Bramhall, all of England

[73] Assignee: Colgate-Palmolive Company, New York, N.Y.

[21] Appl. No.: 949,935

[22] Filed: Oct. 10, 1978

[30] Foreign Application Priority Data

Oct. 14, 1977 [GB] United Kingdom ..... 42864/77

[51] Int. Cl.[3] ..... C11D 3/14; C11D 9/20

[52] U.S. Cl. ..... 252/116; 252/120; 252/131; 252/140; 252/155; 252/531; 252/540; 252/550; 252/559; 252/DIG. 14

[58] Field of Search ..... 252/531, 532, 535, 536, 252/539, 540, 140, 155, 163, 550, 551, 554, 555, 558, 559, DIG. 14, 113, 116, 120, 121, 128

[56] References Cited

U.S. PATENT DOCUMENTS

| | | | |
|---|---|---|---|
| 3,149,078 | 9/1964 | Zmoda | 252/90 X |
| 3,210,285 | 10/1965 | Gangwisch | 252/155 X |
| 3,214,380 | 10/1965 | Gangwisch | 252/100 |
| 3,281,367 | 10/1966 | Jones et al. | 252/112 |
| 3,677,954 | 7/1972 | Nakajima et al. | 252/121 |
| 3,956,158 | 5/1976 | Donaldson | 252/102 |
| 3,957,695 | 5/1976 | Davies et al. | 252/532 |
| 4,005,027 | 1/1977 | Hartman | 252/95 |
| 4,107,067 | 8/1978 | Murphy et al. | 252/135 |
| 4,122,025 | 10/1978 | Kiewert et al. | 252/173 |
| 4,129,423 | 12/1978 | Rubin | 51/304 |
| 4,129,527 | 12/1978 | Clark et al. | 252/547 |
| 4,244,840 | 1/1981 | Straw | 252/540 |

FOREIGN PATENT DOCUMENTS

| | | | |
|---|---|---|---|
| 47-22906 | 10/1972 | Japan | 252/540 |

*Primary Examiner*—P. E. Willis, Jr.

*Attorney, Agent, or Firm*—Richard N. Miller; Murray M. Grill; Herbert S. Sylvester

[57] ABSTRACT

A liquid hard surface cleaning composition comprising, by weight, 1% to 20% of water-insoluble, particulate abrasive having a particle size in the range of 1 to 40 microns; 3% to 15% of a synthetic, organic, anionic detergent; 1% to 7.5% of an ethyleneoxylated alkanol nonionic detergent, the weight ratio of anionic detergent to nonionic detergent being from 1.75:1 to 3:1; 1% to 15% of a detergent builder salt, the weight ratio of builder salt to total detergent being in the range of 1:4 to 2:1; and an aqueous medium; the proportions of the components being so adjusted within the specified ranges that some of the detergent is present in liquid crystal form and the abrasive is maintained in stable suspension.

11 Claims, No Drawings

ALL-PURPOSE LIQUID ABRASIVE CLEANER

This invention relates to liquid cleaning compositions suitable for cleaning hard surfaces, hereinafter referred to as liquid hard surface cleaning compositions.

Liquid hard surface cleaning compositions have generally been classified into two types. The first type are particulate aqueous suspensions having water-insoluble abrasive particles suspended therein. Some of the compositions of this type suffer a stability problem. The second type are the so-called all purpose liquid detergents intended for general cleaning purposes not requiring an abrasive.

The invention can provide liquid hard surface cleaning compositions that combine the functions of both the above-mentioned types of liquid hard surface cleaning composition in a satisfactory manner.

According to the invention a liquid hard surface cleaning composition comprises, by weight:

(i) from 1% to 20% of water-insoluble particulate abrasive of particle sizes in the range from 1μ to 40μ;

(ii) from 3% to 15% of water-soluble synthetic anionic detergent;

(iii) from 1% to 7.5% of water-soluble alkyleneoxylated alkanol nonionic detergent; and (iv) from 1% to 15% of water-soluble builder in an aqueous medium, the proportions of the components being so adjusted within the specified ranges that some of the detergent is present in liquid crystal form and the abrasive is maintained in stable suspension.

The proportions of the components within the specified ranges which will provide the requisite properties are to some extent mutually dependent. For any given proportion of one component, appropriate proportions of the others can readily be ascertained by routine trial and error experiments. Alternatively, one can simply follow the Examples herein.

Although the invention does not depend on the correctness of the theory it may be that the builder drives some of the detergent (probably wholly or mainly anionic detergent) out of solution and into liquid crystal form, thereby increasing the viscosity of the composition, and it may be that there is some physical interaction between the liquid crystals and the abrasive particles whereby the latter are hindered from settling out and remain stably suspended.

The composition may be used undiluted as an abrasive-containing cleanser of pourable, stable, creamy consistency. Alternatively, if the composition is diluted, the detergent all, or substantially all, becomes a solute, the viscosity of the composition is lowered and the abrasive comes out of suspension. The composition can then be used in the same manner as a conventional all purpose liquid detergent.

Compositions embodying the invention have been found to exhibit effective removal of grease and other soils from glass, woodwork, vitreous, painted and enamelled surfaces, and from metal surfaces such as aluminium ware and copper pan bottoms, with effective polishing action and virtually no scratching. The compositions are also effective for removing soil from vehicle tires, for removing wax from waxed surfaces, and for a variety of other applications.

The compositions can be formulated to exhibit a high degree of stability upon storage at normal room temperature of about 70° F. over a period of many months without any appreciable precipitation or formation of layers. When subjected to elevated temperatures of about 100° F. or cooled to about 40° F. the compositions may remain stable. As a result of this stability, even when only very small quantities are dispensed the components will be present in the correct proportions. The compositions may be packaged in any suitable containers such as metal, plastic or glass bottles, bags, cans or drums.

Synthetic anionic detergents employed in the compositions can be broadly described as water-soluble salts, particularly alkali metal salts, of organic sulphuric reaction products having in the molecular structure a higher alkyl radical (i.e., an alkyl radical containing from 6 to 22 carbon atoms in a straight or branched chain) and a radical selected from sulphonic acid or sulphuric acid ester radicals, and mixtures thereof. Illustrative examples of synthetic anionic detergents are sodium and potassium alkyl sulphates, especially those obtained by sulfating the higher alcohols produced by reducing the glycerides of tallow or coconut oil; sodium and potassium alkyl benzene sulphonates in which the alkyl group contains from 9 to 15 carbon atoms, especially those of the type described in U.S. Pat. Nos. 2,220,099 and 2,477,383; sodium alkyl glyceryl ether sulphates, especially those ethers of the higher alcohols derived from tallow and coconut oil; sodium coconut oil fatty acid monoglyceride sulphates; sodium and potassium salts of sulphuric acid esters of the reaction products of one mole of a higher fatty alcohol (e.g. tallow or coconut oil alcohols) and about one to five, preferably three, moles of ethylene oxide; sodium and potassium salts of alkyl phenol ethylene oxide ether sulphate with about four units of ethylene oxide per molecule and in which the alkyl radicals contain about 9 carbon atoms; the reaction product of fatty acids esterified with isethionic acid and neutralized with sodium hydroxide where, for example, the fatty acids are derived from coconut oil, and mixtures thereof; and others known in the art, a number being specifically set forth in U.S. Pat. Nos. 2,486,921; 2,486,922 and 2,396,278.

The most highly preferred water-soluble synthetic anionic detergents are the ammonium and substituted ammonium (such as mono, di and triethanolamine), alkali metal (such as sodium and potassium) and alkaline earth metal (such as calcium and magnesium) salts of higher alkyl benzene sulphonates and mixtures with $C_{12}$–$C_{20}$ olefin sulphonates, higher alkyl sulphates and the higher fatty acid monoglyceride sulphates. The most preferred are higher alkyl aromatic sulphonates, e.g., sodium salts of higher alkyl benzene sulphonates or of higher-alkyl toluene, xylene or phenol sulphonates, alkyl naphthalene sulphonate, ammonium diamyl naphthalene sulphonate, and sodium dinonyl naphthalene sulphonate. Mixed long chain alkyls derived from coconut oil fatty acids and the tallow fatty acids can also be used along with cracked paraffin wax olefins and polymers of lower monoolefins. In one type of composition there may be used a linear alkyl benzene sulphate having a high content of 3 (or higher) phenyl isomers and a correspondingly low content (well below 50%) of 2 (or lower) phenyl isomers; in other terminology the benzene ring is preferably attached in large part at the 3 or higher (e.g. 4, 5, 6 or 7) position of the alkyl group and the content of isomers at which the benzene ring is attached at the 2 or 1 position is correspondingly low. Mixtures of various cations can be used.

Nonionic detergents employed in the compositions can be broadly described as water-soluble compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements; for example, the condensation product of aliphatic alkanols having from 8 to 22 carbon atoms, in either straight or branched chain configuration, with ethylene oxide, such as a coconut alcohol ethylene oxide condensate having from 2 to 15 moles of ethylene oxider per mole of coconut alcohol.

Suitable alkanols are those having a hydrophobic character, preferably having from 8 to 22 carbon atoms, more preferably saturated fatty alcohols having 8 to 18 carbon atoms. Examples thereof are iso-octyl, nonyl, decyl, dodecyl, tridecyl, tetradecyl, hexadecyl, octadecyl and oleyl alcohols which may be condensed with the appropriate amount of ethylene oxide, such as at least 2 moles, preferably 3 to 8, but up to about 15 moles. A typical product is tridecyl alcohol, produced by the oxo process, condensed with about 2, 3 or 6 moles of ethylene oxide. Where desired, a mixture of ethylene oxide and propylene oxide, may be used in place of ethylene oxide in the foregoing condensates, with the proportions of ethylene oxide and propylene oxide being selected so that the resultant condensate will exhibit water-solubility. The corresponding higher alkyl thioalcohols condensed with ethylene oxide are also suitable for use in the compositions of the invention.

Still other suitable nonionics are the polyoxyethylene polyoxypropylene adducts of 1-butanol. The hydrophobe of these nonionics has a minimum molecular weight of 1,000 and consists of an aliphatic monohydric alcohol containing from 1 to 8 carbon atoms to which is attached a heteric chain of oxyethylene and oxypropylene. The weight ratio of oxypropylene to oxyethylene covers the range of 95:5 to 85:15. Attached to this is the hydrophilic polyoxyethylene chain which is from 44.4 to 54.6 of the total molecular weight. The compounds formed by condensing ethylene oxide with a hydrophobic base formed by the condensation of propylene oxide with propylene glycol which are sold under the trademark "Pluronic" also can be used. The molecular weight of the hydrophobic portion of the molecule is of the order of 950 to 4,000 preferably 1,200 to 2,500. The addition of polyoxyethylene radicals to the hydrophobic portion tends to increase the solubility of the molecule as a whole. The molecular weight of the block polymers varies from 1,000 to 15,000, and the polyethylene oxide content may comprise 20% to 80% by weight.

The builder employed in the composition may be a single compound or mixture. Where a mixture is employed it may be a mixture of similar salts, e.g., sodium carbonate and sodium bicarbonate, and/or sodium silicate or a mixture of two distinct classes, e.g., an inorganic salt and an organic salt; for example, an alkali metal carbonate and an alkali metal salt of an organic acid. Suitable builder salts include the sodium, potassium and ammonium salts of ethylene diaminetriacetic acid and nitrilotriacetic acid, sodium and potassium tripolyphosphate, sodium and potassium acid pyrophosphates, sodium and potassium pyrophosphates, trisodium and tripotassium phosphates, sodium and potassium phosphates, sodium and potassium carbonates and bicarbonates, and sodium and potassium silicates having a mole ratio of sodium or potassium oxide ($M_2O$) to silicon dioxide ($SiO_2$) of 1:1.5 to 1:4. Particularly satisfactory compositions result when 1–3% by weight of sodium silicate is used in admixture with a phosphate builder salt or a mixture of sodium carbonate and sodium bicarbonate.

Small amounts of sodium or potassium chloride or sulfate may be included in the liquid hard surface compositions for the purpose of modifying viscosity.

The particulate abrasive employed may be calcite, preferably finely ground natural calcite, which is calcium carbonate in which substantially all of the carbonate is in the calcite crystalline form. Other abrasives used in cleanser compositions may be employed, such as silica and feldspar, e.g., labradorite. The particles will be in the particle size range from 1$\mu$ to 40$\mu$. For the more highly abrasive materials such as silica the particle size should be in the lower end of the said range, e.g., from 1$\mu$ to 5$\mu$, to minimize scratching, but for less abrasive materials such as calcite larger particles can be employed, e.g., from 2$\mu$ to 40$\mu$.

A higher fatty acid soap is an optional component which may be employed in amounts of up to 2.5%, preferably from 0.5% to 1% by weight for the purpose of modifying the amount and nature of the foam produced. It may be formed in situ, for instance by including a higher fatty acid as a component in a formulation containing sodium carbonate builder. Urea is another optional component and may be employed in amounts of up to 8% by weight, preferably from 2 to 4% where employed. Its use may be dictated by the anionic detergent employed.

Further optional additives such as dyes, perfumes and germicides may also be included in the composition in conventional amounts, not exceeding 5% by weight in total.

The balance of the composition is water.

The amount of abrasive present is preferably from 5% to 15%, by weight.

The amount of anionic detergent employed is preferably from 3% to 12% by weight; while the amount of nonionic detergent is preferably from 2% to 4% by weight. The weight ratio of one to the other may vary and preferably is from 1.75:1 to 3:1, e.g., about 2:1.

The amount of builder employed is preferably from 2% to 6% by weight. Where two distinctly different classes of builder salt are employed, the weight ratio of one to the other may be from 10:1 to 1:10, preferably from 3:1 to 1:3. The weight ratio of builder to anionic detergent is preferably in the range from 1:3 to 2:1. The ratio of builder to nonionic detergent is preferably in the range from 1:1 to 2:1. The weight ratio of builder salt to total detergent is preferably in the range from 1:4 to 2:1.

The compositions of the invention may be produced by any of the techniques commonly employed in the manufacture of liquid detergent compositions. Generally, the compositions are produced by a batch process wherein the anionic detergent and soap are mixed with water under moderate agitation at a temperature in the range of about 25° C. to 60° C., preferably 30° C. to 50° C. to form a solution. The water-insoluble abrasive is dispersed in the solution of anionic detergents with good agitation and, thereafter the nonionic detergent ingredient and the water-soluble builder salts are added with agitation. The resultant composition is cooled to about 25° to 30° C., if necessary, while continuing the agitation and the perfume is added along with any color solution and/or any preservative such as formalin. In the foregoing process the anionic detergent and, optionally, soap may be added in salt form or in acid form. When the acid form is used, the desired sodium or potassium hydroxide will be added to the water prior to the addition of the anionic detergent and soap in acid form. Such procedure results in the formation of a desirable self-opacified phase wherein part of the detergent is present in the form of liquid crystals. The proportions of the various ingredients are suitably adjusted to provide a minimum viscosity of 350–500 centipoises (cps) as measured on a Brookfield Viscometer using the #3 spindle at a speed of 20 R.P.M. Generally, the viscosity will range from 350 cps. to about 1500, preferably from 600 to 1000 cps.

The following Examples illustrate the invention. All percentages are by weight.

EXAMPLE 1

| Component | % |
|---|---|
| Calcium carbonate abrasive[a] | 10.0 |
| Sodium $C_9$–$C_{13}$ alkylbenzene sulfonate | 5.0 |
| $C_9$–$C_{11}$alkanol condensed with 5 moles of ethylene oxide (nonionic detergent) | 2.5 |
| Sodium carbonate | 2.7 |
| Sodium bicarbonate | 1.3 |
| Palm kernel/coconut oil fatty acids[b] | 0.7 |
| Perfume | 0.4 |
| Water to | 100.0 |

[a]Ground natural calcite having a particle size range of 2–40 microns and a median particle size of 5 microns.
[b]Converted to about 0.8% by weight of the sodium salt in the final product due to presence of sodium carbonate.

EXAMPLE 2

| Component | % |
|---|---|
| Calcium carbonate of Example 1 | 10 |
| Sodium $C_9$–$C_{13}$ alkylbenzene sulfonate | 3.5 |
| $C_9$–$C_{11}$ alkanol condensed with 5 moles of ethylene oxide | 2.0 |
| Sodium carbonate | 2.7 |
| Sodium bicarbonate | 1.3 |
| Palm kernel/coconut oil fatty acids[a] | 0.5 |
| Perfume | 0.4 |
| Water to | 100 |

[a]Present as 0.55% of the sodium salt in final product due to presence of sodium carbonate.

EXAMPLE 3

| Component | % |
|---|---|
| Calcium carbonate of Example 1 | 10.0 |
| Sodium $C_9$–$C_{13}$ alkylbenzene sulfonate | 12.0 |
| $C_9$–$C_{11}$ alkanol condensed with 5 moles of ethylene oxide | 4.0 |
| Sodium carbonate | 2.7 |
| Sodium bicarbonate | 1.3 |
| Perfume | 0.4 |
| Water to | 100 |

EXAMPLE 4

| Component | % |
|---|---|
| Calcium carbonate of Example 1 | 10.0 |
| Sodium $C_9$–$C_{13}$ alkylbenzene sulfonate | 3.5 |

-continued

| Component | % |
|---|---|
| $C_9$–$C_{11}$ alkanol condensed with 5 moles of ethylene oxide | 2.0 |
| Sodium carbonate | 5.3 |
| Sodium bicarbonate | 2.7 |
| Urea | 3.0 |
| Perfume | 0.4 |
| Water to | 100 |

EXAMPLE 5–16

Examples 1–4 are repeated except that the sodium alkylbenzene sulfonate detergent has alkyl chain lengths of $C_7$ to $C_{14}$, $C_{10}$ to $C_{12}$ and $C_{10}$ to $C_{14}$, respectively.

EXAMPLES 17–18

Examples 1 and 2 are repeated except that coconut oil fatty acids are substituted for the mixture of palm kernel/coconut oil fatty acids.

EXAMPLES 19 and 20

Example 1 is repeated except that a $C_9$–$C_{13}$ alkanol condensed with 4 and 6 moles, respectively, of ethylene oxide is used as the nonionic detergent.

EXAMPLE 21

Example 3 is repeated except that potassium pyrophosphate is substituted for the mixture of sodium carbonate and sodium becarbonate.

EXAMPLE 22

Example 3 is repeated except that trisodium nitrilotriacetate is employed instead of the mixture of sodium carbonate and sodium bicarbonate.

EXAMPLE 23

| Component | % |
|---|---|
| Sodium $C_9$–$C_{13}$ linear alkylbenzene sulfonate | 5 |
| $C_9$–$C_{11}$ alkanol condensed with 5 moles of ethylene oxide | 2.5 |
| Sodium coconut oil $C_8$–$C_{18}$ fatty acid soap | 0.8 |
| Calcium carbonate of Example 1 | 10.0 |
| Sodium carbonate | 3.0 |
| Sodium bicarbonate | 1.0 |
| Formalin | 0.1 |
| 1% Tartrazine yellow solution | 0.8 |
| Perfume | 0.4 |
| Water to | 100 |

The foregoing composition is stable at room temperature and is effective at removing soil from hard surfaces. Both the anionic detergent and the soap were formed during the process of making the composition as the acid form of each was added to the composition along with sodium hydroxide.

EXAMPLE 24

The composition of Example 23 is repeated except that the proportion of calcium carbonate is reduced from 10% to 5% and the proportion of water is increased by 5%. The resultant product is satisfactory.

EXAMPLES 25 and 26

The composition of Example 24 is repeated except that 1.5% and 2.5% by weight of sodium silicate having an $Na_2O$ to $SiO_2$ mole ratio of 1:3.26 respectively are included in the composition and the proportion of water is correspondingly reduced. The resultant products exhibited particularly satisfactory stability upon aging and, thus, represent preferred compositions.

EXAMPLES 27 and 28

The composition of Example 23 is repeated except that silica and Labradorite (a magnesium aluminosilicate) of a particle size in the range of 1 to 40 microns are respectively substituted for the calcium carbonate abrasive. These products were stable upon aging and were similar in performance to the composition of Example 23.

EXAMPLE 29

The composition of Example 23 is repeated except that a builder mixture of 2.8% by weight of trisodium nitrilotriacetate monohydrate and 5% by weight sodium carbonate is substituted for the sodium carbonate-sodium bicarbonate builder mixture and the proportion of water is adjusted accordingly. The resultant product is comparable in soil removal to the product of Example 23.

EXAMPLE 30

| Component | % |
|---|---|
| Calcium carbonate of Example 1 | 10.0 |
| Sodium $C_9$–$C_{13}$ linear alkyl benzene sulfonate | 5.7 |
| $C_9$–$C_{11}$ alkanol condensed with 5 moles of ethylene oxide | 2.75 |
| Sodium carbonate | 4.0 |
| Sodium bicarbonate | 1.0 |
| Perfume | 0.4 |
| Water to | 100 |

What is claimed is:

1. A stable, opaque, liquid hard surface cleaning composition comprising, by weight, from 1% to 20% of a water-insoluble, particulate, inorganic abrasive having a particle size in the range of 1 to 40 microns; from 3% to 12% of a water-soluble, synthetic, organic, anionic detergent salt of a sulfuric reaction product having a $C_6$–$C_{22}$ alkyl group and either a sulfonic acid or sulfuric acid radical in its molecular structure; from 2% to 4% of a water-soluble condensation product of a $C_8$–$C_{22}$ alkanol and 2 to 15 moles of ethylene oxide, the weight ratio of anionic detergent to nonionic detergent being from 1.75:1 to 3:1; from 1% to 15% of water-soluble inorganic or organic detergent builder salt, the weight ratio of builder salt to total detergent being in the range of 1:4 to 2:1; and an aqueous medium; the proportions of the components being so adjusted within the specified ranges that some of the detergent is present in liquid crystal form and the abrasive is maintained in stable suspension, said composition having a viscosity in the range of 350 to 1500 centipoises.

2. A composition according to claim 1 wherein the abrasive is selected from the group consisting of calcium carbonate of calcite crystalline form, silica and feldspar.

3. A composition according to claim 1 wherein said anionic detergent is a sodium or potassium salt.

4. A composition according to claim 1 wherein said builder salt is a 10:1 to 1:10 mixture, by weight, of organic and inorganic non-phosphate alkali metal builder salts.

5. A composition according to claim 4 wherein the builder is a mixture of sodium carbonate and sodium bicarbonate.

6. A composition according to claim 1 wherein the builder salt is a mixture of salts which includes 1% to 3% by weight of an alkali metal silicate having an alkali metal oxide to silicon dioxide mole ratio of 1:1.5 to 1:4.

7. A composition according to claim 1 which includes in addition up to 2.5% by weight of a water-soluble $C_8$–$C_{18}$ fatty acid soap.

8. A composition according to claim 1 which includes in addition up to 8% by weight of urea.

9. A composition according to claim 1 wherein the proportion of abrasive is 5% to 15by weight and the proportion of builder salt is from 2% to 6% by weight.

10. A composition according to claim 9 wherein said abrasive is calcium carbonate and said composition further includes up to 2.5% by weight of a water-soluble sodium $C_8$–$C_{18}$ fatty acid soap.

11. A composition according to claim 10 wherein said anionic detergent is a sodium $C_9$–$C_{15}$ alkylbenzene sulfonate and said builder salt mixture optionally includes up to 3% by weight of sodium silicate having an $Na_2O$ to $SiO_2$ mole ratio of 1:1.5 to 1:4.

* * * * *